US007234429B2

(12) United States Patent
Abe et al.

(10) Patent No.: US 7,234,429 B2
(45) Date of Patent: Jun. 26, 2007

(54) SPARK PLUG WITH INCREASED DURABILITY

(75) Inventors: Nobuo Abe, Yokkaichi (JP); Yasushi Kawashima, Mie-ken (JP); Tsunetoshi Goto, Handa (JP)

(73) Assignee: DENSO Corporation (JP)

( * ) Notice: Subject to any disclaimer, the term of this patent is extended or adjusted under 35 U.S.C. 154(b) by 0 days.

(21) Appl. No.: 11/213,899

(22) Filed: Aug. 30, 2005

(65) Prior Publication Data

US 2006/0042610 A1 Mar. 2, 2006

(30) Foreign Application Priority Data

Aug. 31, 2004 (JP) ..... 2004-252885
Jun. 10, 2005 (JP) ..... 2005-170684

(51) Int. Cl.
*F02P 1/00* (2006.01)
*H01T 13/20* (2006.01)

(52) U.S. Cl. ..... 123/169 R; 313/141

(58) Field of Classification Search ..... 123/169 R, 123/169 E; 313/141, 142, 143, 144, 145
See application file for complete search history.

(56) References Cited

U.S. PATENT DOCUMENTS 6,334,800 B1 * 1/2002 Nishikawa et al. ..... 445/7
6,407,487 B1 * 6/2002 Sugimoto ..... 313/141
6,559,579 B2 * 5/2003 Ito et al. ..... 313/143
6,566,792 B2 * 5/2003 Nishikawa ..... 313/118
6,590,318 B2 * 7/2003 Nishikawa et al. ..... 313/143
6,632,381 B2 * 10/2003 Sugimoto ..... 264/12
6,680,561 B2 * 1/2004 Yamaguchi et al. ..... 313/118
6,771,009 B2 * 8/2004 Nishikawa et al. ..... 313/118
2002/0000765 A1 * 1/2002 Suzuki ..... 313/141
2002/0024160 A1 * 2/2002 Sugimoto ..... 264/12

FOREIGN PATENT DOCUMENTS

JP 5-55489 7/1993

* cited by examiner

*Primary Examiner*—John T. Kwon
(74) *Attorney, Agent, or Firm*—Nixon & Vanderhye PC

(57) ABSTRACT

A spark plug is provided which is designed to be compact without sacrificing a mechanical strength of a porcelain insulator. The spark plug includes a metal shell having a base end and a top end. The porcelain insulator is made of a hollow cylinder which includes a body and an insulator head. The body is retained within the metal shell. The insulator head extends from the base end of the metal shell in a lengthwise direction of the porcelain insulator and has a length made up of a major body leading to the body of the porcelain insulator and an end portion lying far away from the body. The major body has an outer diameter D1, an inner diameter D2, and a section modulus Z at a smallest-outer diameter portion thereof which meet relations of 7.1 mm≦D1≦8.8 mm, D2≧2.8 mm, and Z≧33 mm$^3$.

7 Claims, 7 Drawing Sheets

SPARK PLUG WITH INCREASED DURABILITY

CROSS REFERENCE TO RELATED DOCUMENT

The present application claims benefits of Japanese Patent Application No. 2004-252885 filed on Aug. 31, 2004 and Japanese Patent Application No. 2005-170684 filed on Jun. 10, 2005 the disclosures of which are incorporated herein by reference.

BACKGROUND OF THE INVENTION

1. Technical Field of the Invention

The present invention relates generally to a spark plug with increased durability for internal combustion engines which may be used in automotive vehicles, co-generation systems, or gas feed pumps.

2. Background Art

Internal combustion engines used in, for example, automotive vehicles employ spark plugs to ignite an air-fuel mixture. Such spark plugs are being increasingly required to improve combustion in the engine for reducing the fuel consumption or emissions thereof. The improvement of the combustion requires improvement of thermal efficiency and compression ratio in the engine which may, however, result in self-ignition of the mixture in combustion chambers of the engine, thus leading to engine knocking.

The engine knocking may be eliminated by improving a cooling system such as a water jacket provided around the spark plugs to enhance the cooling of the engine.

Modern engines are quipped with a direct injection mechanism or a variable valve-timing mechanism for enhancing the performance thereof and complex in structure of an engine head.

The improvement of cooling of the engine, therefore, requires a decrease in installation space for the spark plug. For instance, Japanese Utility Model First Publication No. 5-55489 teaches techniques for decreasing the diameter of a plug installation thread formed on a metal shell of the spark plug. This, however, results in need for decreasing the diameter of a porcelain insulator of the spark plug, which gives rise to a decrease in mechanical strength thereof. This increases the possibility of breakage of the porcelain insulator due to engine vibrations.

There are known ignition devices having an ignition coil installed just above the spark plug in direct connection therewith for the purpose of minimizing electrical noises arising from the distributor or simplifying a high-voltage wiring arrangement. The ignition coil is fitted on the porcelain insulator of the spark plug and fixed on a head cover installed on the engine head. The spark plug is installed directly on the engine head.

The above structure, however, has the problem in that engine vibrations may be transmitted to a joint between the ignition coil and the spark plug, so that an undesirable mechanical load or stress is applied to the head of the porcelain insulator of the spark plug. Specifically, when the engine vibrations applied to the engine head in which the spark plug is installed and the head cover in which the ignition coil is installed differ in direction or phase from each other, it will cause a bending force or stress to act on the porcelain insulator. Thinning of the porcelain insulator, therefore, increases the possibility of breakage of the porcelain insulator due to the engine vibrations.

Electrical insulation of the spark plug from the ignition coil working to produce high voltage is usually achieved by fitting a coil boot of the ignition coil with the porcelain insulator firmly. Specifically, the high voltage, as developed by the ignition coil, is transmitted to the center electrode of the spark plug through a terminal of the spark plug and a conductor installed in the porcelain insulator to produce sparks in a spark gap between the center electrode and the ground electrode to ignite the mixture in the engine. When the coil boot is loosen from the head of the porcelain insulator, so that a greater gap exits between them, it may result in the so-called flashover in which the current leaks to the head of the porcelain insulator, which gives rise to a lack of spark in the spark gap, thus decreasing the ignitability of the mixture in the engine.

Particularly, increasing in the spark gap caused by wear of the electrodes of the spark plug will result in a rise in voltage of discharge. Further, deterioration or hardening of the coil boot caused by long use of the spark plug results in a decrease in electrical insulation ability thereof, which may result in a discharge to the surface of the porcelain insulator (i.e., the flashover), thereby leading to misfiring in the engine.

Conversely, the coil boot is fitted on the head of the porcelain insulator too tightly, a greater effort is required to pull the coil boot out of the spark plug. Particularly, when the coil boot is fit on the spark plug, air within the coil boot will expand during running of the engine and contract during stop of the engine. The removal of the spark plug is usually made when the engine is at rest and cool. A negative pressure or vacuum is, thus, developed in the coil boot, thus resulting in an increase in effort required to pull the coil boot from the spark plug. If the coil boot is pulled by force, it may result in damage to the coil boot or breakage of or cracks in the porcelain insulator. Specifically, firm fitting of the coil boot with the head of the porcelain insulator facilitates ensuring of electrical insulation therebetween, but may be a factor of damage to the coil boot or breakage of or cracks in the porcelain insulator.

SUMMARY OF THE INVENTION

It is therefore a principal object of the invention to avoid the disadvantages of the prior art.

It is another object of the invention to provide an improved structure of a spark plug designed to be compact in size without sacrificing mechanical strength or durability thereof.

According to one aspect of the invention, there is provided a spark plug for an internal combustion engine which comprises: (a) a metal shell having a base end and a top end opposed to the base end in a lengthwise direction of the spark plug; (b) a hollow cylindrical porcelain insulator having a length which includes a body and an insulator head, the body being retained within the metal shell, the insulator head extending from the base end of the metal shell in a lengthwise direction of the porcelain insulator, the porcelain insulator having an inner chamber extending in the body and the insulator head; (c) a center electrode retained within the inner chamber of the porcelain insulator in alignment with the length of the porcelain insulator; and (d) a ground electrode extending from the top end of the metal shell to define a spark gap between itself and the center electrode. The insulator head of the porcelain insulator has a length made up of a major body leading to the body of the porcelain insulator and an end portion lying far away from the body of the porcelain insulator. The major body has an outer diameter D1, an inner diameter D2, and a section modulus Z at a smallest-outer diameter portion thereof which meet relations of 7.1 mm≦D1≦8.8 mm, D2≧2.8 mm, and Z≧33 $mm^3$.

The section modulus Z which is greater than or equal to 33 $mm^3$ at the smallest-outer diameter portion of the major body ensures a desired degree of strength of the porcelain insulator, especially resistance to external pressure oriented perpendicular to the length of the porcelain insulator to cause bending thereof.

The outer diameter D1 at the smallest-outer diameter portion of the major body which is within a range of 7.1 mm to 8.8 mm permits the spark plug to be reduced in size without sacrificing the mechanical strength of the porcelain insulator. Specifically, the outer diameter D1 of 8.8 mm or less allows a thread diameter of the metal shell to be decreased, which leads to a reduction in size of the spark plug. The outer diameter D1 of 7.1 mm or more assures the section modulus Z lying within the above range to ensure a required mechanical strength of the porcelain insulator.

The inner diameter D2 at the smallest-outer diameter portion of the major body which is within a range of 2.8 mm or more ensures mechanical strength of joint of, for example, the center electrode, a terminal electrode, and a resistor retained inside the porcelain insulator to the porcelain insulator. Specifically, the inner diameter D2 of 2.8 mm or more assures an area of, for example, glass seals to be welded to the porcelain insulator, thereby offering a desired strength to fix the center electrode in the porcelain insulator.

In the preferred mode of the invention, the metal shell is equipped with a plug installation tool-fitted portion which has a regular hexagonal transverse section extending perpendicular to an axial of the metal shell. A distance H1 between opposite two of sides of the hexagonal transverse section is selected to meet a relation of 11.7 mm≦H1≦14 mm. This permits the spark plug to be reduced in size.

The plug installation tool-fitted portion may alternatively have a profile contoured to that of a shape defined by two regular hexagonal sections which are identical in size, laid to overlap each other, and are shifted about an axis of the metal shell by 30° in a circumferential direction thereof. A distance H2 between opposite two of sides of each of the hexagonal transverse sections is selected to meet a relation of 11.7 mm≦H1≦14 mm.

The metal shell has a thread for use in installation of the spark plug in an internal combustion engine. The thread has a thread diameter M satisfying a relation of 8 mm≦M≦12 mm.

The insulator head the porcelain insulator has a length L which meets a relation of 22 mm≦L≦28 mm. The ensures the resistance of the insulator head to a mechanical load oriented in a direction perpendicular to the length of the porcelain insulator.

The major body of the insulator head of the porcelain insulator may have a smooth outer peripheral surface without corrugations which has an area within a range of 400 $mm^2$ to 600 $mm^2$. This achieves a desired fit of the insulator head with, for example, a coil boot of an ignition coil.

The major body of the insulator head of the porcelain insulator may alternatively have corrugations formed on an outer peripheral surface thereof. The outer peripheral surface has an area which occupies a depth range of 0 mm to 0.1 mm from a top of each of the corrugations and is within a range of 400 $mm^2$ to 600 $mm^2$.

According to another aspect of the invention, there is provided an ignition device which may be used to ignite fuel in an internal combustion engine which comprises: (a) a spark plug to be installed in a head of an internal combustion engine; and (b) an ignition coil to be installed in a head cover covering the head of the engine in engagement with the insulator head of the spark plug. The spark plug has any of structures, as described above.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
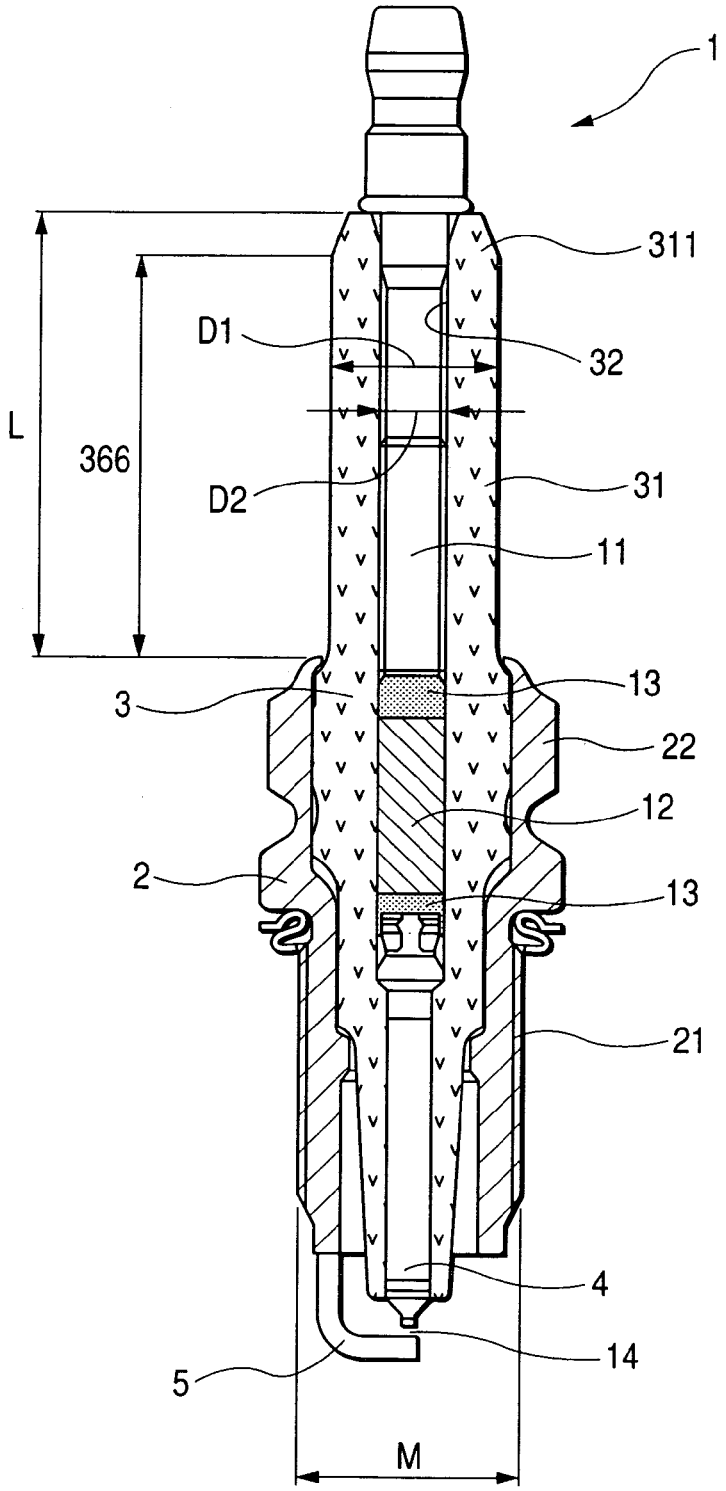
FIG. 1 is a longitudinal sectional view which shows a spark plug according to the first embodiment of the invention.

Referring now to the drawings, particularly to FIG. 1, there is shown a spark plug 1 for automotive internal combustion engines according to the first embodiment of the invention.

The spark plug 1 generally includes a hollow cylindrical metal shell 2, a porcelain insulator 3, a center electrode 4, and a ground electrode 5. The porcelain insulator 3 is retained in the metal shell 2 to have an insulator head 31 extending outside the metal shell 2 toward the base end (i.e., an upper portion as viewed in the drawing) of the spark plug 1. The center electrode 4 is retained in a center hole 32 formed in the porcelain insulator 3. The ground electrode 5 extends from the metal shell 2 and faces the center electrode 4 through a spark gap 14.

The metal shell 2 has a thread 21 for installation in the internal combustion engine and a hexagonal head 22 on which a wrench is to be fitted to install or remove the spark plug 1 in or from the engine.

The insulator head 31 has a length L extending outside an end of the metal shell 2. The length L is made up of a major body 366 and a tapered end 311. The major body 366 has an outer diameter D1, an inner diameter D2, and a section modulus Z ($Z=\pi(D1^4-D2^4)/(32\ D1)$) at a smallest-outer diameter portion thereof which meet relations below.

$$7.1\ mm \leqq D1 \leqq 8.8\ mm$$

$$D2 \geqq 2.8\ mm$$

$$Z \geqq 33\ mm^3$$

The tapered end 311 has a length of 4 mm from a base end (i.e., an upper end as viewed in the drawing) of the insulator head 31.

The major body 366 may extend straight and have a constant diameter. In this case, the major body 366 has the diameter D1 over the length thereof.

The reason why the smallest-outer diameter portion of the insulator head 31 having the diameters D1 and D2 and the section modulus Z excludes the tapered end 311 is that a bending load or stress acting on the insulator head 31 usually hardly concentrates at the end thereof, that is, that the end of the insulator head 31 is most insensitive to the bending stress.

The inner diameter D2 is identical with the diameter of the center hole 32 at the smallest-outer diameter portion of the insulator head 31.

Figure 2:
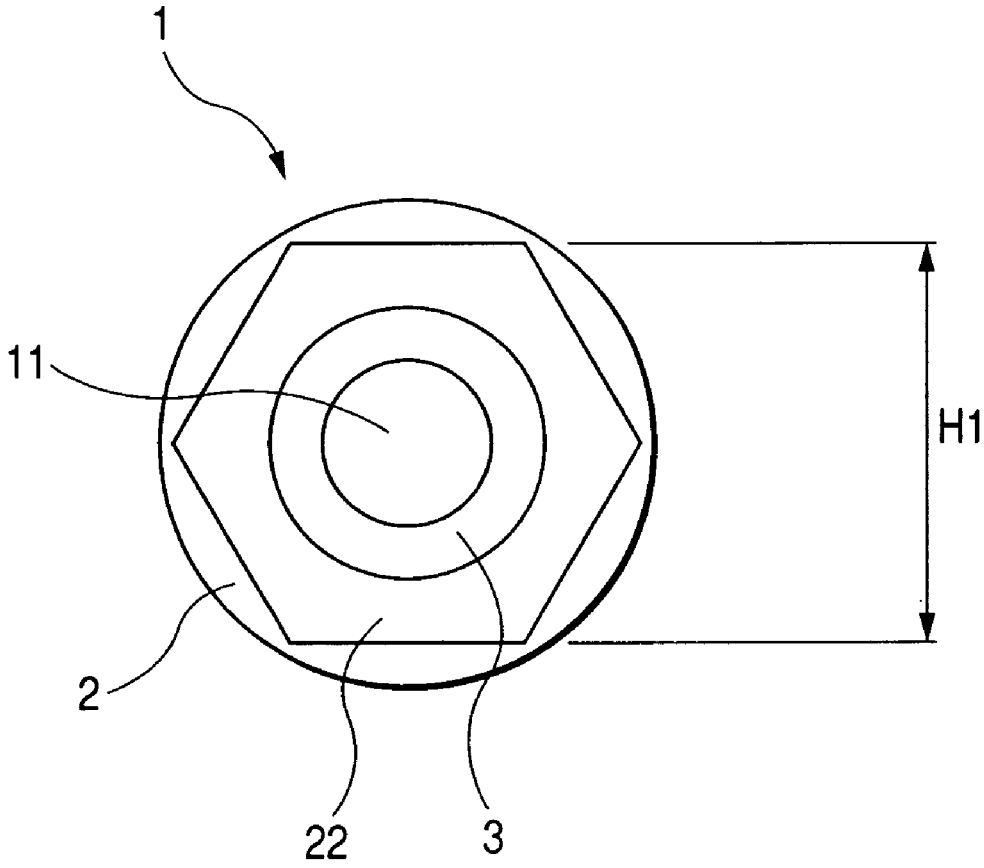
FIG. 2 is a plan view, as viewed from a base end side of the spark plug of FIG. 1.

The hexagonal head 22, as clearly illustrated in FIG. 2, has a regular hexagonal transverse section extending perpendicular to a longitudinal center line of the metal shell 2 (i.e., the spark plug 1). An opposite side-to-side distance H1 of the hexagonal transverse section is selected to meet a relation of 11.7 mm≦H1≦14 mm.

The thread 21 has a thread diameter M meeting a relation of 8 mm≦M≦12 mm.

The length L of the insulator head 31, as referred to herein, is, as described above, a portion of the porcelain insulator 3 extending from the base end (i.e., the upper end as viewed in FIG. 1) of the metal shell 2 to the tip of the tapered end 311. The length L is selected to meet a relation of 22 mm≦L≦28 m.

Within the center hole 32 of the porcelain insulator 3, the center electrode 4, a resistor 12, and a terminal electrode 11 are disposed in alignment with each other. The resistor 12 is interposed between the center electrode 4 and the terminal electrode 11 hermetically through glass seals 13. The glass seals 13 are boned or welded to the inner wall of the porcelain insulator 3 and the end of the resistor 12 to retain the resistor 12 in place within the center hole 32.

The resistor 12 is made of a carbon-based material and formed by filling the center hole 32 with carbon powder under pressure. Each of the glass seals 13 is formed by a copper glass made of a mixture of glass and copper (Cu) powder.

The insulator head 13 has a smooth peripheral surface without corrugations The major body 366 of the insulator head 13 has an outer peripheral area of 400 $mm^2$ to 600 $mm^2$.

Figure 3:
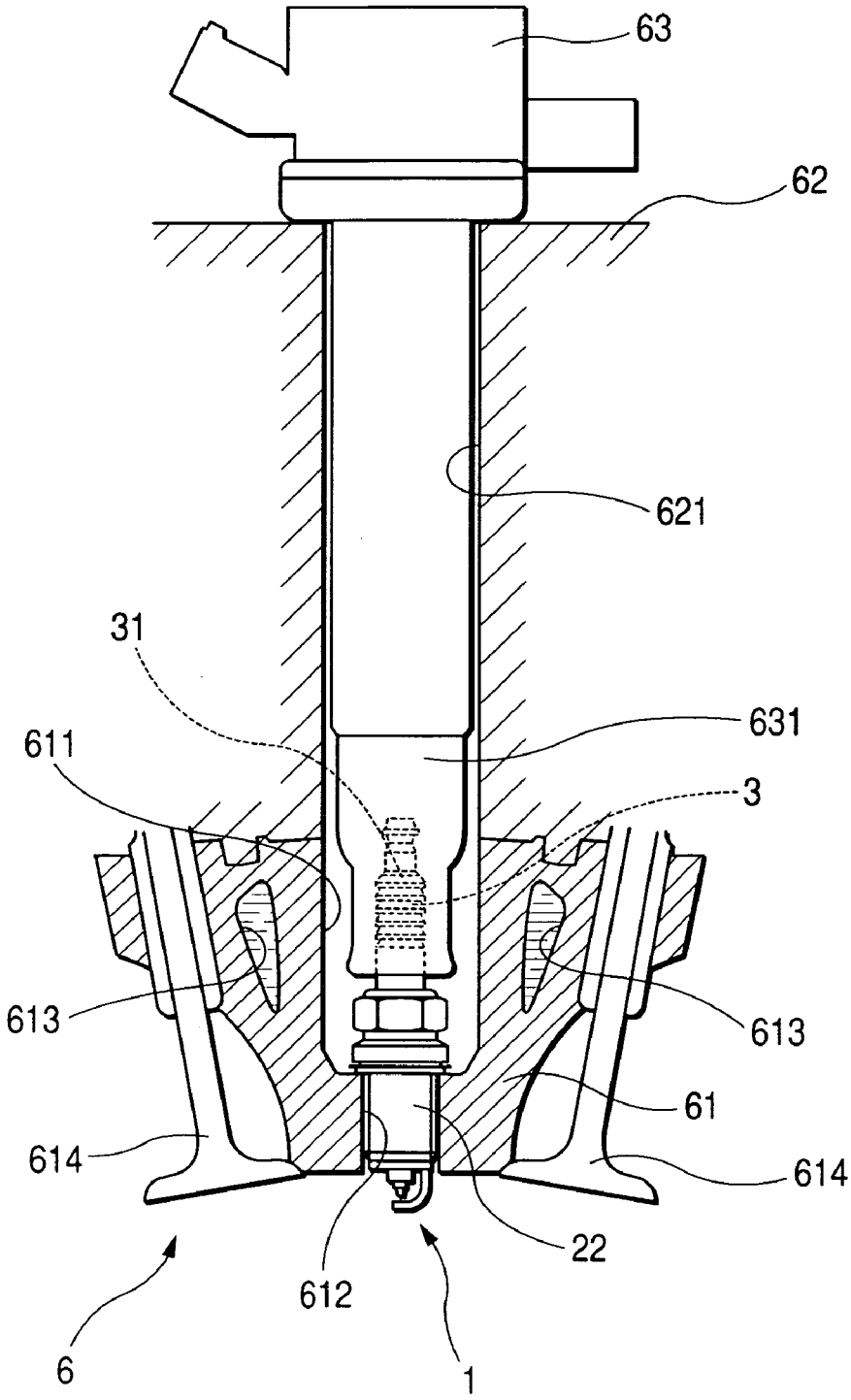
FIG. 3 is a longitudinal sectional view which shows an ignition device equipped with the spark plug of FIG. 1

FIG. 3 illustrates an ignition device 6 equipped with the spark plug 1 and an ignition coil 63. The spark plug 1 is installed in a head 61 of the internal combustion engine. The ignition coil 63 is installed in a head cover 62 disposed over the head 61 of the engine in electrical communication with the spark plug 1.

The ignition coil 63 is the so-called stick coil and has a coil boot 631 made of a hard rubber. The coil boot 631 is fitted on the insulator head 31 of the spark plug 1. An area of contact of the coil boot 631 with the insulator head 31 is identical with the outer peripheral area of the major body 366, as described above. In other words, the coil boot 631 is placed substantially in contact with an entire periphery of the insulator head 31.

The head 61 and the head cover 62 have formed therein plug holes 611 and 612 within which the spark plug 1 and the ignition coil 63 are to be disposed. The head 61 also has a plug mount hole 612 formed therein in alignment with the plug hole 611 into which the head 21 of the spark plug 1 is to be screwed.

A water jacket 613 and valves 614 of the engine are disposed around the plug hole 611.

The spark plug 1 has the section modulus Z, as described above, which is greater than or equal to 33 $mm^3$ at the smallest-outer diameter portion of the major body 366 of the insulator head 31, thereby ensuring a desired degree of strength of the porcelain insulator 3, especially resistance to external pressure oriented perpendicular to the length of the porcelain insulator 3 to cause bending thereof.

The insulator head 31 has the outer diameter D1 at the smallest-outer diameter portion of the major body 366 which is selected to be within a range of 7.1 mm to 8.8 mm, thereby permitting the spark plug 1 to be reduced in size without sacrificing the mechanical strength of the porcelain insulator 3. Specifically, the outer diameter D1 of 8.8 mm or less allows the thread diameter of the metal shell 2 to be decreased, thereby reducing the size of the spark plug 1. The outer diameter D1 of 7.1 mm or more assures the section modulus Z lying within the above range to ensure a required mechanical strength of the porcelain insulator 3.

The insulator head 31 also has the inner diameter D2 at the smallest-outer diameter portion of the major body 366 which is selected to be within a range of 2.8 mm or more, thereby ensuring the mechanical strength of joints of the center electrode 4, the terminal electrode 11, and the resistor 12 to the porcelain insulator 3. Specifically, the inner diameter D2 of 2.8 mm or more assures an area of the glass seals 13 to be welded to the porcelain insulator 3, thereby offering a desired strength to fix the center electrode 4 in the porcelain insulator 3.

The opposite side-to-side distance H1 of the hexagonal head 22 is, as described above in FIG. 2, placed within a range of 11.7 mm to 14 mm, thereby permitting the spark plug 1 to be made compact in size without sacrificing the section modulus Z, as described above.

The thread diameter M of the metal shell 2 is, as already described, within a range of 8 mm to 12 mm, thereby also permitting the spark plug 1 to be made compact in size without sacrificing the section modulus Z.

The length L of the insulator head 31 is, as described above, within a range of 22 mm to 28 mm, thereby ensuring the mechanical strength thereof against the pressure oriented in a direction perpendicular to the length of the porcelain insulator 3 and the insulation resistance between the metal shell 2 and the center electrode 4.

The major body 366 of the insulator head 13 has, as described above, an outer peripheral area of 400 $mm^2$ to 600 $mm^2$, thereby ensuring a desired amount of fitting with the coil boot 631 of the ignition coil 63. Specifically, it achieves a close fit between the insulator head 31 and the coil boot 631 and facilitates ease of removal of the coil boot 631 from the insulator head 31. This assures the insulation ability of the porcelain insulator 3 and also minimizes mechanical damage to the porcelain insulator 3 or the coil boot 631.

The ignition device 6 is, as can be seen from FIG. 3, designed to have the ignition coil 63 which is to be fit on the insulator head 31 of the spark plug 1. Usually, mechanical vibrations of the engine transmit to the head 61 and the head cover 62. In some cases, the vibrations acting on the head 61 may be shifted in direction or phase from those on the head cover 62, which causes the spark plug 1 installed in the head 61 and the ignition coil 63 installed in the head cover 62 to vibrate in directions or phases different from each other, thus resulting in mechanical stress acting on the insulator head 31 which works as a joint between the spark plug 1 and the ignition coil 63. In order to withstand such stress, the spark plug 1 is designed to have the dimensions as described above.

The spark plug 1 is, as described above, allowed to be reduced in size thereof, thus enabling installation spaces around the spark plug 1 to be occupied by parts such as the water jacket 613 or the valves 614 to be increased, thereby enhancing the performance of the engine.

Figure 4:
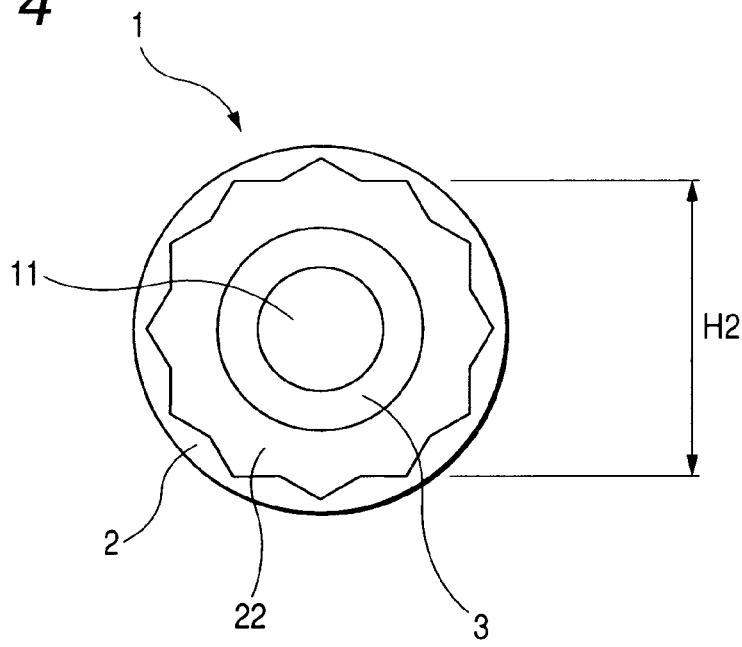
FIG. 4 is a plan view, as viewed from a base end side of a spark plug of the second embodiment of the invention.

FIG. 4 is a plan view which shows the metal shell 2 of the spark plug 1 according to the second embodiment of the invention. The metal shell 2 has a plug installation tool-fitted portion 22 identical in function with the hexagonal head 22 of the spark plug 1 of the first embodiment in FIGS. 1 and 2.

The plug installation tool-fitted portion 22 has a profile contoured to that of a shape defined by two regular hexagonal sections which are identical in size, laid to overlap each other, and are shifted about the longitudinal center line of the metal shell 2 by 30° in a circumferential direction thereof.

A opposite side-to-side distance H2 of each of the hexagonal sections overlapping each other is selected to meet a relation of 11.7 mm≦H1≦14 mm.

Other arrangements are identical with those in the spark plug 1 of the first embodiment, and explanation thereof in detail will be omitted here.

Figure 5:
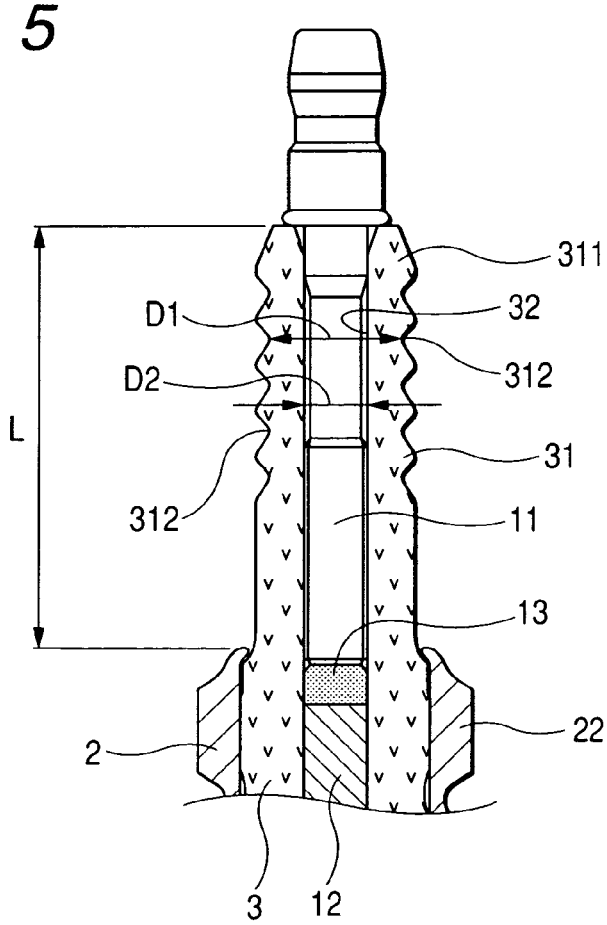
FIG. 5 is a partially longitudinal sectional view which shows a spark plug according to the third embodiment of the invention.
Figure 6:
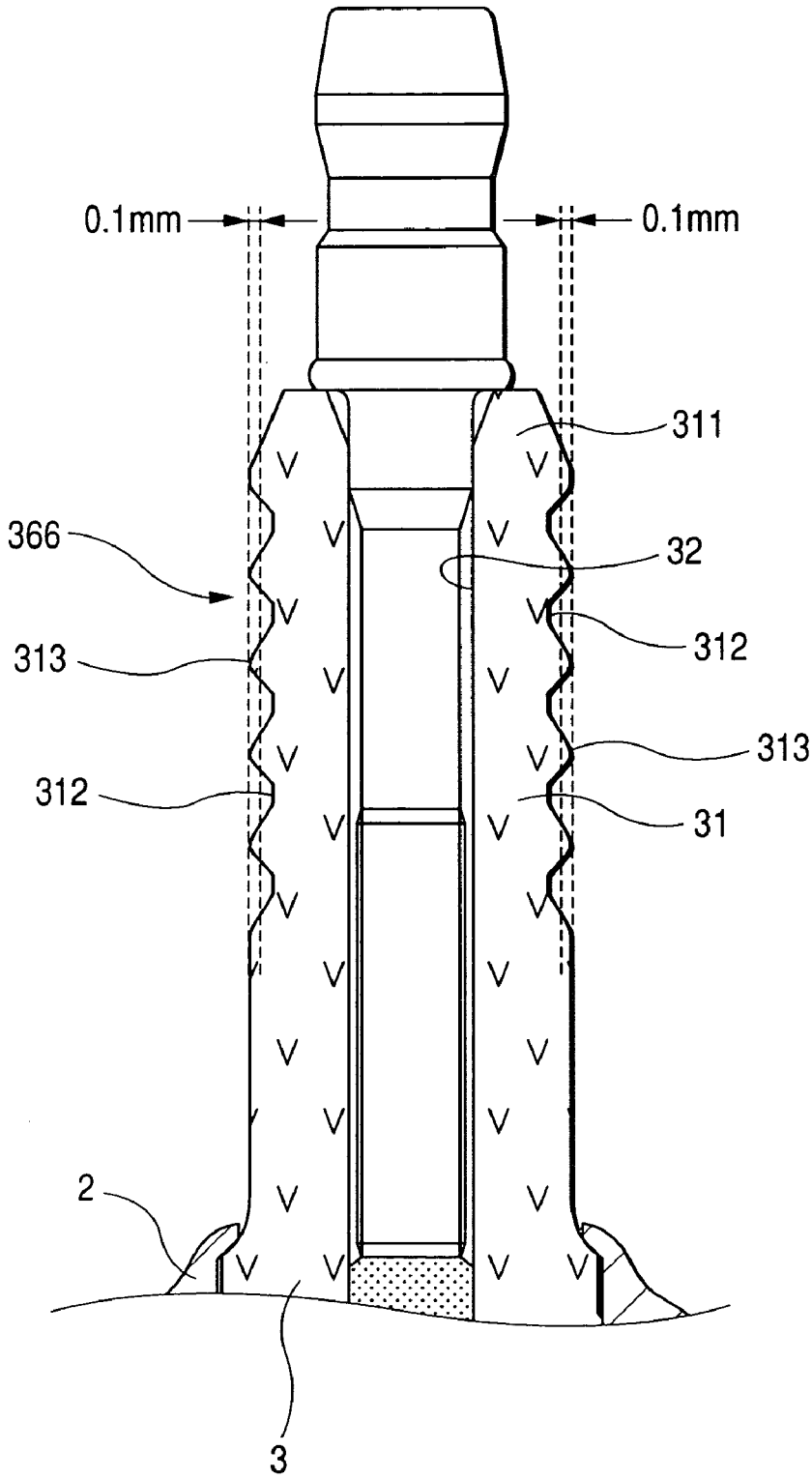
FIG. 6 is an enlarged view of FIG. 5.

FIGS. 5 and 6 show the spark plug 1 according to the third embodiment of the invention which has the insulator head 31 with ribs or corrugations. The corrugations extend in a circumferential direction of the insulator head 31 and are each defined by a bottom or trough 312 and a peak or top 313.

The insulator head 31, as clearly shown in FIG. 6, has the outer diameter D1, as identical with the one in the first embodiment, at the troughs 312.

The major body 366 of the insulator head 31, like the first embodiment, has an outer peripheral area of 400 $mm^2$ to 600 $mm^2$ that is an area of the outer surface of the insulator head 31 to be in contact with the coil boot 631 of the ignition device 6 of FIG. 3 and illustrated in FIG. 6 by a solid heavy line. Specifically, the outer peripheral area is an outer area of the major body 366 within a depth range of 0 mm to 0.1 mm from the top 313 of each of the corrugations. In other words, it is an outer side area of a portion of the porcelain insulator 3 extending outside the metal shell 2 except an outer area of the tapered portion 311 and an outer area of each of the troughs 312 within a depth range of 0.1 mm or more from the top 313.

Other arrangements of the spark plug 1 are identical with those in the first embodiment, and explanation thereof in detail will be omitted here.

In the above structure of the spark plug 1, portions of the insulator head 31 in which the troughs 312 are formed is relatively lower in mechanical strength. In order to secure a required mechanical strength, the insulator head 31 is designed to have the outer diameter D1, the inner diameter D2, and the section modulus Z at the troughs 312 which meet the following relations, respectively.

$$7.1\ \text{mm} \leqq D1 \leqq 8.8\ \text{mm}$$

$$D2 \geqq 2.8\ \text{mm}$$

$$Z \geqq 33\ \text{mm}^3$$

The insulator head 13 is, as described above, designed to have an outer peripheral area of 400 $mm^2$ to 600 $mm^2$ which is to be fitted with the coil boot 631 of the ignition coil 63, thereby ensuring a desired amount of contact with the coil boot 631 of the ignition coil 63. Specifically, it achieves a close fit between the insulator head 31 and the coil boot 631 and facilitates ease of removal of the coil boot 631 from the insulator head 31. This assures the insulation ability of the porcelain insulator 3 and also minimizes mechanical damage to the porcelain insulator 3 or the coil boot 631.

The corrugations serve to increase an outer area of the porcelain insulator 31 per unit length, thus enhancing the insulation ability thereof.

We have performed tests to evaluate the resistance of the spark plug 1 to mechanical vibrations. We prepared and used the ignition device 6, as illustrated in FIG. 3, and plug samples identical in structure with the spark plug 1 of the third embodiment, as illustrated in FIGS. 5 and 6, except the dimensions D1, D2, and Z.

Figure 7:
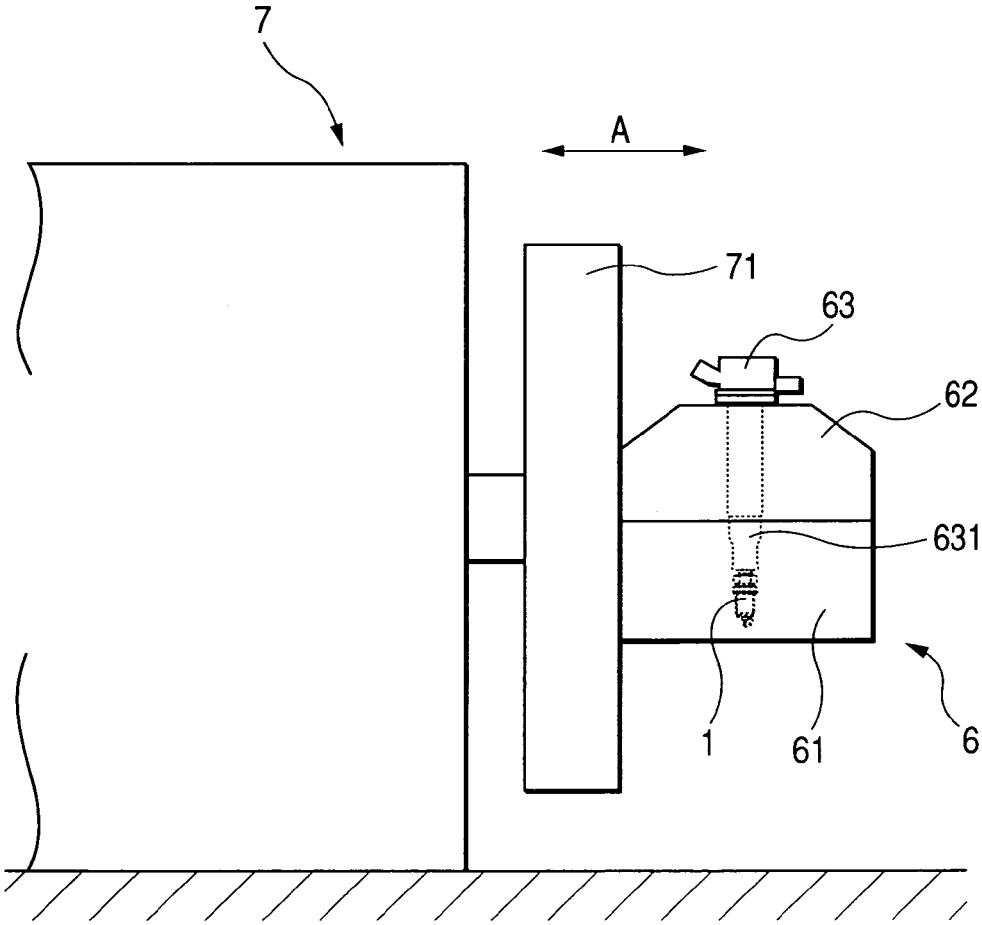
FIG. 7 is a side view which shows a vibration test machine used to evaluate the resistance of a spark plug to mechanical vibrations.

Specifically, we prepared the plug samples having different values of the outer diameter D1 within a range of 7.0 to 7.6 mm, the inner diameter D2 within a range of 2.5 to 4.5 mm, and the section modulus Z within a range of 27.9 to 42.6 and performed the tests by, as clearly illustrated in FIG. 7, installing each of the plug samples and the ignition coil 63 in the plug holes 611 and 621 of the engine head 61, mounting the engine head 61 on a table 71 of a vibration exciter 7, and vibrating the table 71 in a horizontal direction, as indicated by an arrow A in FIG. 7, under constant conditions. The head cover 62 was attached to the upper surface of the head 61 using screws.

A maximum acceleration of vibrations added to a joint of the plug sample to the head 61 was selected to be 50 G which is twice a maximum acceleration of 25 G to which a portion of the spark plug mounted directly in a typical high-performance 2000 cc four-cylinder engine running at 8400 rpm is subjected.

Figure 8:
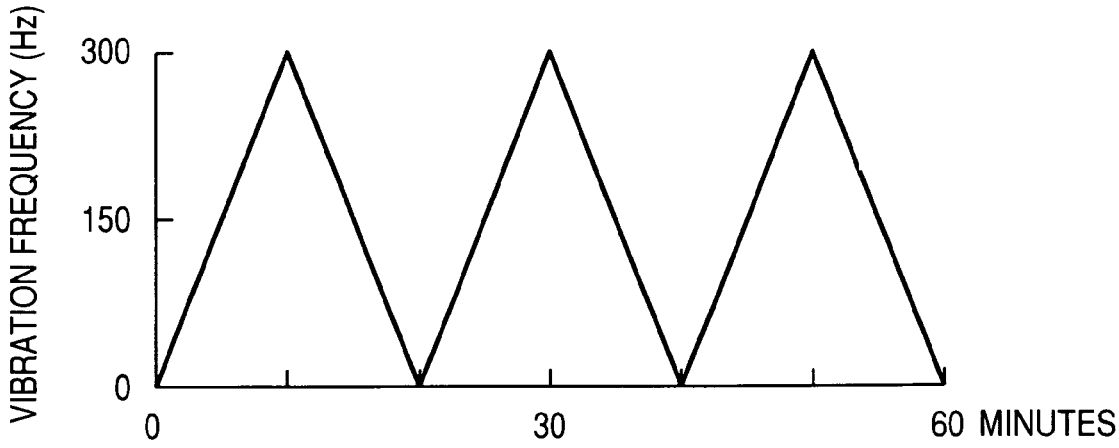
FIG. 8 is a graph which shows the frequency of vibrations added to the spark plug in the vibration test machine of FIG. 7.

The frequency of vibrations added to the plug samples was, as illustrated in FIG. 8, changed within a range of 0 Hz to 300 Hz. Specifically, the vibration frequency was increased from 0 Hz to 300 Hz in a first period of ten (10) minutes and then decreased from 300 Hz to 0 Hz in a subsequent period of ten minutes. This was repeated for one hour.

After the vibration test, we removed each plug sample from the vibration exciter 7, checked cracks in the porcelain insulator 3, and evaluated the mechanical strength of joint of the terminal electrode 11 to the porcelain insulator 3. Table 1, as appears below, demonstrates the presence of cracks in the porcelain insulator 3 of the plug samples. Table 2 demonstrates the joint strength of the terminal electrode 11 of the plug samples. In Table 1, "O" indicates the absence of cracks in the porcelain insulator 3. "X" indicates the presence of cracks in the porcelain insulator 3. The section modulus Z is given by a relation of $Z=(\pi/32)\times(D1^4-D2^4)/D1$. In Table 2, "O" indicates the case where the strength of joint between the terminal electrode 11 and the porcelain insulator 3 remained 70% or more of that before the test. "X" indicates the case where the strength of joint between the terminal electrode 11 and the porcelain insulator 3 dropped to less than 70% of that before the test.

TABLE 1

| | | Insulator head outer diameter D1 (mm) | | | | | | | |
|---|---|---|---|---|---|---|---|---|---|
| | | 7.0 | | 7.2 | | 7.4 | | 7.6 | |
| | | Accept. | Z $mm^3$ | Accept. | Z $mm^3$ | Accept. | Z $mm^3$ | Accept. | Z $mm^3$ |
| Inner diameter D2 (mm) | 2.5 | ○ | 33.1 | ○ | 36.1 | ○ | 39.3 | ○ | 42.6 |
| | 3.0 | X | 32.5 | ○ | 35.5 | ○ | 38.7 | ○ | 42.1 |
| | 3.5 | X | 31.6 | ○ | 34.6 | ○ | 37.8 | ○ | 41.2 |
| | 4.0 | X | 30.1 | ○ | 33.2 | ○ | 36.4 | ○ | 39.8 |
| | 4.5 | X | 27.9 | X | 31.1 | ○ | 34.3 | ○ | 37.8 |

TABLE 2

| | | Insulator head outer diameter D1 (mm) | | | |
|---|---|---|---|---|---|
| | | 7.0 | 7.2 | 7.4 | 7.6 |
| Inner diameter D2 (mm) | 2.5 | X | X | X | X |
| | 3.0 | ○ | ○ | ○ | ○ |
| | 3.5 | ○ | ○ | ○ | ○ |
| | 4.0 | ○ | ○ | ○ | ○ |
| | 4.5 | ○ | ○ | ○ | ○ |

Table 1 shows that when the section modulus Z is greater than 33 $mm^3$, no cracks occur in the porcelain insulator 3, and when the inner diameter D2 is 4.0 mm or less, and the outer diameter D1 is 7.2 or more, no cracks occur in the porcelain insulator 3.

Table 2 shows that when the inner diameter D2 is 2.5 mm, the joint strength of the terminal electrode 11 drops due to vibrations added thereto, and when the inner diameter D2 is 3.0 mm or more, the terminal electrode 11 has a desired degree of the joint strength.

We also performed durability tests to evaluate a drop in the joint strength of the terminal electrode 11 using plug samples having different values of the inner diameter D2 of the insulator head 31 which are selected within a range of 2.5 mm to 3.0 mm.

Specifically, we prepared the plug samples which have the same outer diameter D1 of 7.6 mm and different values of 2.6 mm, 2.7 mm, 2.8 mm, and 2.9 mm in the outer diameter D2. Other arrangements of the plug samples and test conditions are the same as in the tests described above.

Test results show that when the inner diameter D2 is 2.6 mm and 2.7 mm, the joint strength drops below 70% of that before the test, and when the inner diameters D2 is 2.8 mm and 2.9 mm, the joint strength remains 70% or more of that before the test. It is, thus, found that the inner diameter D2 of the insulator head 31 is preferably 2.8 mm or more.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. An ignition device comprising:

a spark plug to be installed in a head of an internal combustion engine, said spark plug having a structure including:

a metal shell having a base end and a top end opposed to the base end in a lengthwise direction of the spark plug;

a hollow cylindrical porcelain insulator having a length which includes a body and an insulator head, the body being retained within said metal shell, the insulator head extending from the base end of said metal shell in a lengthwise direction of said porcelain insulator, said porcelain insulator having an inner chamber extending in the body and the insulator head;

a center electrode retained within the inner chamber of said porcelain insulator in alignment with the length of said porcelain insulator; and a ground electrode extending from the top end of said metal shell to define a spark gap between itself and said center electrode, wherein the insulator head of said porcelain insulator has a length made up of a major body leading to the body of said porcelain insulator and an end portion lying far away from the body of said porcelain insulator, the major body having an outer diameter D1, an inner diameter D2, and a section modulus Z, where $Z=\pi(D1^4-D2^4)/(32\ D1)$ at a smallest-outer diameter portion thereof which meet relations below, $$7.1\ mm \leqq D1 \leqq 8.8\ mm$$

$$D2 \geqq 2.8\ mm$$

$$Z \geqq 33\ mm^3;\ \text{and}$$

an ignition coil to be installed in a head cover covering the head of the engine in engagement with the insulator head of the spark plug.

2. An ignition device as set forth in claim 1, wherein said metal shell is equipped with a plug installation tool-fitted portion which has a regular hexagonal transverse section extending perpendicular to an axial of said metal shell, and wherein a distance H1 between opposite two of sides of the hexagonal transverse section is selected to meet a relation of $11.7\ mm \leqq H1 \leqq 14\ mm$.

3. An ignition device as set forth in claim 1, wherein said metal shell is equipped with a plug installation tool-fitted portion which has a profile contoured to that of a shape defined by two regular hexagonal sections which are identical in size, laid to overlap each other, and are shifted about an axis of said metal shell by 30° in a circumferential direction thereof, and wherein a distance H2 between opposite two of sides of each of the hexagonal transverse sections is selected to meet a relation of $11.7\ mm \leqq H1 \leqq 14\ mm$.

4. An ignition device as set forth in claim 1, wherein said metal shell has a thread for use in installation of the spark plug in an internal combustion engine, the thread having a thread diameter M satisfying a relation of $8\ mm \leqq M \leqq 12\ mm$.

5. An ignition device as set forth in claim 1, wherein the insulator head said porcelain insulator has a length L which meets a relation of 22 mm≦L≦28 mm.

6. An ignition device as set forth in claim 1, wherein the major body of the insulator head of said porcelain insulator has a smooth outer peripheral surface without corrugations which has an area within a range of 400 $mm^2$ to 600 $mm^2$.

7. An ignition device as set forth in claim 1, wherein the major body of the insulator head of said porcelain insulator has corrugations formed on an outer peripheral surface thereof, the outer peripheral surface having an area which occupies a depth range of 0 mm to 0.1 mm from a top of each of the corrugations and is within a range of 400 $mm^2$ to 600 $mm^2$.

* * * * *